US006003497A

United States Patent [19]

Rodier et al.

[11] Patent Number: 6,003,497

[45] Date of Patent: Dec. 21, 1999

[54] MECHANICALLY ACTUATED HYDRAULICALLY AMPLIFIED FUEL INJECTOR WITH ELECTRICALLY CONTROLLED PRESSURE RELIEF

[75] Inventors: William J. Rodier, Germantown Hills; Ronald D. Shinogle, Peoria, both of Ill.

[73] Assignee: Caterpillar Inc., Peoria, Ill.

[21] Appl. No.: 08/332,212

[22] Filed: Oct. 31, 1994

[51] Int. Cl.[6] ..... F02M 37/04

[52] U.S. Cl. ..... 123/506; 239/88

[58] Field of Search ..... 123/506, 446; 239/88

[56] References Cited

U.S. PATENT DOCUMENTS

| | | | |
|---|---|---|---|
| 2,598,528 | 5/1952 | French . | |
| 4,402,456 | 9/1983 | Schneider . | |
| 4,466,390 | 8/1984 | Babitzka et al. . | |
| 4,467,963 | 8/1984 | Sisson et al. . | |
| 4,718,324 | 1/1988 | Takahashi | 123/506 |
| 4,831,988 | 5/1989 | Hoefken et al. | 123/506 |
| 4,889,084 | 12/1989 | Rembold . | |
| 5,121,730 | 6/1992 | Ausman et al. . | |
| 5,143,291 | 9/1992 | Grinsteiner | 239/88 |
| 5,168,855 | 12/1992 | Stone . | |
| 5,413,076 | 5/1995 | Koenigswieser | 123/506 |

FOREIGN PATENT DOCUMENTS

| | | |
|---|---|---|
| 0091372A1 | 10/1983 | European Pat. Off. . |
| 1601006 | 10/1981 | United Kingdom . |
| 2085978A | 5/1982 | United Kingdom . |

*Primary Examiner*—Thomas N. Moulis
*Attorney, Agent, or Firm*—Kevin M. Hinman

[57] ABSTRACT

A fuel injector adapted for an internal combustion engine has a cam driven pumping mechanism, a pressure intensifier mechanism, an injection mechanism, and an electronically responsive relief valve mechanism. The cam driven pumping mechanism has a pumping piston operably reciprocating to pressurize a hydraulic fluid to a first pressure. The pressure intensifier mechanism receives the hydraulic fluid at the first pressure from the pumping mechanism, and acts against fuel to pressurize it to a second pressure greater than the first pressure. The injection mechanism receives the highly pressurized fuel from the intensifier mechanism. The injection mechanism includes a check blocking an orifice in an end portion of the injection mechanism. The pressurized fluid displaces the check away from the end of the injection mechanism by the pressurized second fluid to begin fuel injection. The relief valve mechanism is connected to the first pressure chamber and operably exhausts the first pressure chamber in response to an electrical signal.

3 Claims, 2 Drawing Sheets

MECHANICALLY ACTUATED HYDRAULICALLY AMPLIFIED FUEL INJECTOR WITH ELECTRICALLY CONTROLLED PRESSURE RELIEF

TECHNICAL FIELD

The present invention relates generally to fuel injectors, and more particularly to electronically controlled fuel injectors.

BACKGROUND ART

An example of a mechanical, cam driven pressurized fuel injector is provided in U.S. Pat. No. 4,467,963 to Sisson et al. on Aug. 28, 1984. It has a pumping piston biased upward by a return spring and operably displaced downward by a cam driven rocker arm. A solenoid operated control valve, disposed between a pressure chamber on which the piston acts, and a low pressure fuel pump, is movable between an open position and a closed position. With the solenoid in the closed position, fuel in a timing chamber pressurized by the downwardly moving pumping piston is blocked from reaching the fuel pump and is forced against a metering piston. The metering piston pressurizes fuel in a metering chamber, forcing it through flow orifices, thereby injecting it into the combustion chamber. The solenoid moves to the open position when the piston is moving upward, allowing the timing chamber to be replenished by the fuel pump.

Present and future emission laws, and performance requirements, require that today's fuel systems pressurize fuel to pressures on the order of 138 MPa (20,000 psi) or higher. The entire mechanism, including solenoid operated valves, such as the one discussed above, must sustain fuel pressures of this magnitude. Such pressures can be difficult to sustain over extended periods of time without developing leaks between the pumping piston and the surrounding housing. Additionally, solenoid operated valves in injectors like that disclosed by Sisson et al. must be fabricated with a high degree of precision to prevent leakage at the valve seats under maximum pressure conditions.

U.S. Pat. No. 5,121,730 to Ausman et al. on Jun. 16, 1992, discloses a hydraulically actuated, electronically controlled injector which reduces the risk of fuel leakage by elevating the pressure of the fuel at a location proximate to the injection end of the injector. In this injector, moderately pressurized hydraulic fluid, for example, engine lubrication oil at about 23 MPa (3,335 psi), pressurized by an external pump, is used to pressurize fuel through an intensifier piston which multiplies the pressure of the oil to pressurize the fuel at a location relatively close to the injection orifices. The resultant fuel pressure is approximately 161 MPa (23,345 psi). This system, however, requires providing the external oil pump which elevates the oil pressure to the 23 MPa level.

It is desired to provide a fuel injector employing pressurized hydraulic fluid in combination with an intensifier piston to pressurize the fuel without employing an external pump to increase the pressure of the hydraulic fluid. It is also desired to minimize any cold start problems associated with the use of higher viscosity hydraulic fluid in the injectors.

The present invention is directed to overcoming one or more of the problems as set forth above.

DISCLOSURE OF THE INVENTION

In one aspect of the present invention, a fuel injector for an internal combustion engine is disclosed comprising a pumping piston and injector body combination, a fuel pressurizing and injection unit, and an electronically responsive pressure relief valve. The pumping piston of the pumping piston and injector body combination is slidably disposed in an axial bore within the injector body. The injector body and a first end of the pumping piston define a hydraulic pressure chamber at an end of the axial bore. The fuel pressurizing and injection unit has an intensifier piston disposed in a piston chamber which is fluidly connected to the hydraulic pressure chamber. A plunger having an operative surface area smaller than an operative surface area of the intensifier piston is displaced with the intensifier piston and defines a fuel pressure chamber. A check cavity fluidly connected with the fuel pressure chamber has a check slidably disposed therein. The check is spring biased to a first position blocking an injection orifice in an end of the injector body and is operably displaced to a second position spaced from the end of the body by high pressure fuel. The pressure relief valve is fluidly connected with the hydraulic pressure chamber. The valve is selectively movable between an exhaust position wherein fluid displaced by the pumping piston is dumped, and a pressure position wherein fluid displaced by the pumping piston hydraulically acts against the intensifier piston.

In another aspect of the present invention, a fuel injector for an internal combustion engine is disclosed comprising an injector body having an axial bore. A pumping piston is slidably disposed in a pumping portion of the axial bore at a first end of the injector body and defines a hydraulic pressure chamber at an end portion of the pumping portion. An intensifier piston is slidably disposed in a piston chamber portion of the axial bore and has a first operative area and a first side which is fluidly connected with the hydraulic pressure chamber. A plunger disposed on a second side of the intensifier piston has an end portion slidably disposed in a plunger cavity for pressurizing fuel in a fuel pressure chamber at an end portion of the plunger cavity. A check is slidably disposed in a check portion of the axial bore and is operatively movable between a closed position in which a tip of the check blocks an injection orifice at an end portion of the axial bore and an open position with the tip spaced from the injection orifice. A spring is disposed between the check and the injector body, biasing the check to the closed position. A relief valve is disposed across a dump port fluidly connected with the hydraulic pressure chamber and is operably movable between an open position permitting fluid to flow through the dump port, and a closed position blocking fluid flow through the dump port. A solenoid is functionally connected to the relief valve and is selectively actuated to displace the relief valve between the open position and the closed position.

In yet another aspect of the present invention, a fuel injector for an internal combustion engine is disclosed comprising a cam driven pumping mechanism, a pressure intensifier mechanism, an injection mechanism, and an electronically responsive relief valve mechanism. The cam driven pumping mechanism has a pumping piston operably reciprocating to pressurize hydraulic actuating fluid to a first pressure. The pressure intensifier mechanism has a first chamber which receives hydraulic actuating fluid at the first pressure from the pumping mechanism. The hydraulic actuating fluid acts against a first portion of a piston which has a first operating surface area and is slidably disposed in the first chamber. The piston has a second portion with a second operating surface area smaller than the first operating surface area disposed in part in a second chamber containing fuel. The fuel is pressurized to a second pressure approximately equal to the first pressure multiplied by a ratio of the first operating surface area to the second operating surface area. The injection mechanism receives the pressurized fuel from the intensifier mechanism and has a check blocking an orifice in an end portion of the injection mechanism. The pressurized fuel displaces the check away from the end portion of the injection mechanism to begin fuel injection. The relief valve mechanism is connected to the first pressure chamber and operably exhausts the first pressure chamber to terminate fuel injection in response to an electronic signal.

The relief valve of the presently disclosed fuel injector, employing hydraulic actuating fluid with the intensifier piston and plunger combination, is exposed to maximum pressures of, for example, only about 34 MPa (5,000 psi). A rapid end of fuel injection can be established using the relief valve. The relief valve also provides variable fuel injection timing capabilities. The lower fluid pressure to which the relief valve is exposed facilitates the manufacture of the valve as manufacturing tolerances related to the valve seating can be relaxed. The use of a pumping piston to locally pressurize actuating fluid instead of remotely located external pump is advantageous in that there would be an increase in efficiency due to the lower volume of actuating fluid required, cold starting capabilities would be improved due to the proximity of the pressurizing source, and the external pump and connecting fluid passages could be eliminated.

BEST MODE FOR CARRYING OUT THE INVENTION

Figure 1:
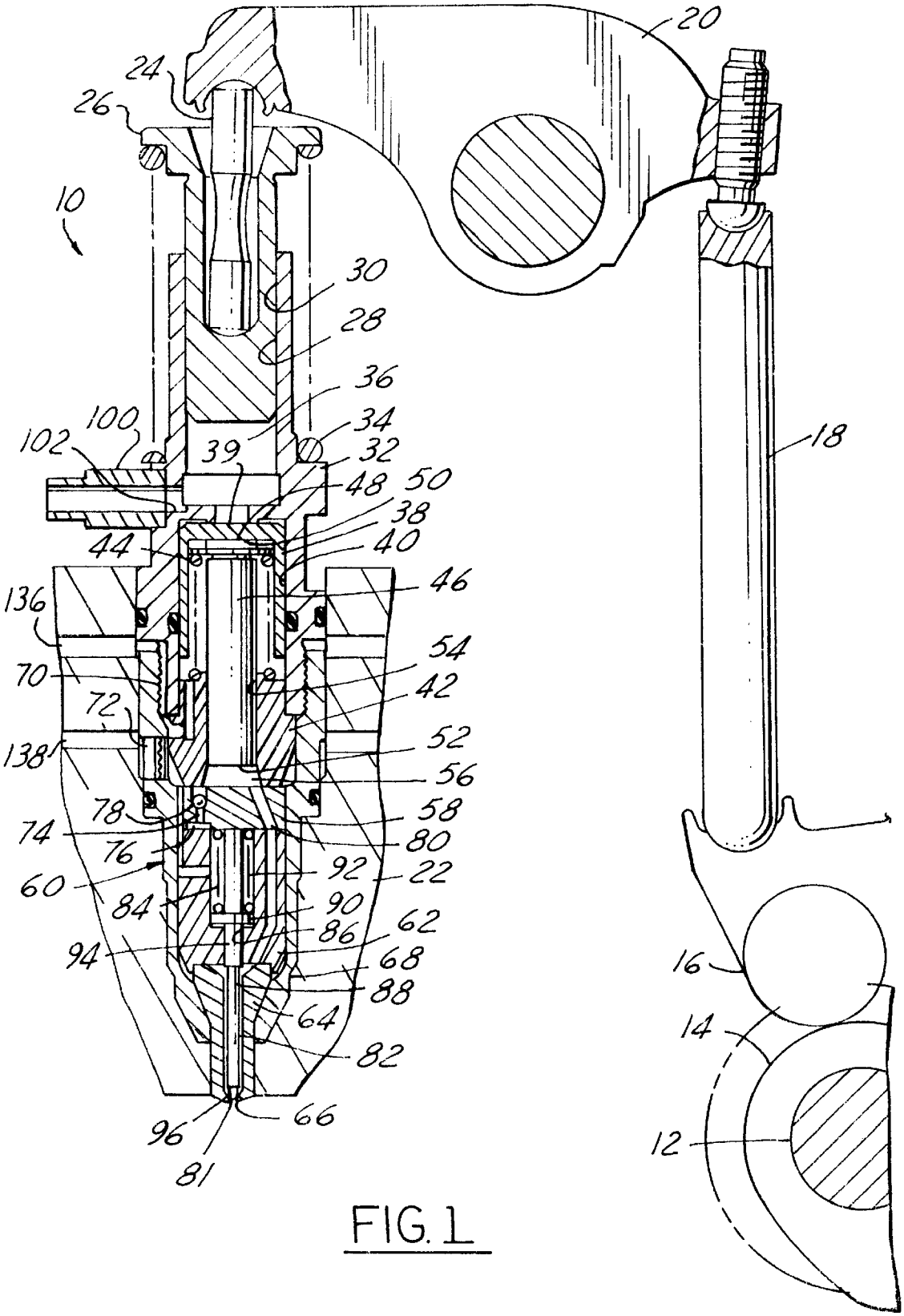
FIG. 1 is a diagrammatic cross sectional view of a fuel injector which is adapted to be connected to the connector and poppet valve of FIG. 1.
Figure 2:
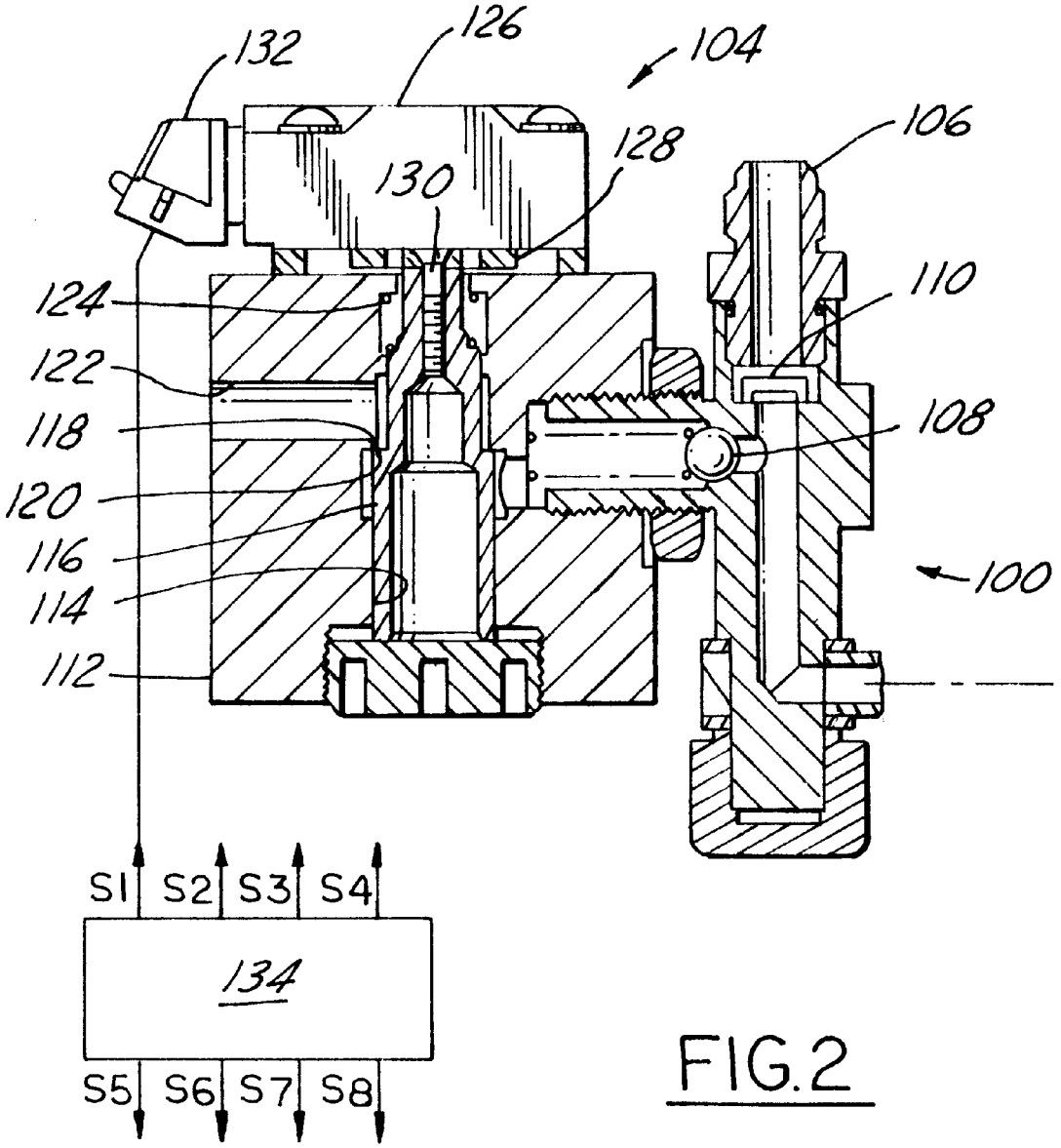
FIG. 2 is a diagrammatic cross sectional view of an actuator valve and connector of a fuel injector.

Referring to FIGS. 1 and 2, wherein the same reference numerals designate the same elements or features throughout both of FIGS. 1 and 2, a first embodiment of a mechanically actuated hydraulically amplified electronically controlled fuel injector 10 is shown therein.

The injector 10, shown in FIG. 1, is mechanically actuated by a cam shaft 12 having a plurality of cam lobes 14. A cam follower 16 follows a perimeter of one of the cam lobes 14. A push rod 18 is disposed between a rotatable rocker arm 20 and the cam follower 16. The rocker arm 20 is pivotally mounted on an engine cylinder head 22. A reciprocal tappet 24 is disposed between the fuel injector 10 and the rocker arm 20. The tappet 24 engages a pumping piston 26 of the injector 10. The tappet is disposed in a recess of the pumping piston 26. The pumping piston 26 is slidably disposed in a pumping portion 28 of an axial bore 30 passing through the entire injector, and including an upper injector body 32. A return spring 34, disposed between the upper injector body 32 and the pumping piston 26, biases the pumping piston 26 upward against the tappet 24 and rocker arm 20. The pumping piston 28 and the upper injector body 32 define a hydraulic pressure chamber 36 at an end portion of the pumping portion 28 of the axial bore 30.

An intensifier piston 38 is slidably disposed in a piston chamber portion 40 of the axial bore 30. The intensifier piston 38 has a first side 39 with an operative or effective surface area Al against which fluid from the hydraulic pressure chamber 36 acts. The piston chamber portion 40 is fluidly connected with the hydraulic pressure chamber 36. A barrel section 42 is disposed at an end portion of the upper injector body 32 in the axial bore 30. The intensifier piston 38 is trapped between the barrel section 42 and the upper injector body 32 with a piston spring 44 biasing the intensifier piston 38 away from the barrel section 42. A plunger 46 is fixed at a first end portion 48 to a second side 50 of the intensifier piston 38. A second end portion 52 of the plunger 46 is disposed in a plunger cavity portion 54 of the axial bore 30 provided within the barrel section 42, defining a second operative or effective surface area A2. The second end 52 also defines an end portion of a fuel pressure chamber 56 within the plunger cavity portion 54 between the second end 52 and a stop 58 disposed across the plunger cavity portion 54.

The stop 58 is retained by a lower injector body 60 which includes a check guide 62, a nozzle tip 64 defining an end portion 66 of the injector, and a casing 68 retaining the nozzle tip 64 and check guide 62 in place relative to the rest of the injector by threadingly engaging the upper injector body 32. The check guide 62 is disposed between the stop 58 and the nozzle tip 64. An annular chamber 70 is defined by the casing 68 around the barrel section 42, the stop 58, and the guide check 62. The casing 68 provides a fuel fill opening 72 between an outside of the injector and the annular chamber 70.

The stop 58 defines a fuel inlet 74 which preferably includes an edge fuel filter 76 between the annular chamber 70 and the fuel pressure chamber 56. A check valve 78 permitting fuel to flow from the edge filter 76 to the pressure chamber 56 and preventing flow in the opposite direction is disposed between the edge filter 76 and the pressure chamber 56. The stop 58 also defines a first portion of a discharge passage 80 from the fuel pressure chamber 56 to one or more fuel injection orifices 81 defined in the nozzle tip 64 at the end portion 66 of the injector 10. The discharge passage 80 passes through both the stop 58 and the check guide 62 to an injection chamber 82 defined by the nozzle 64.

The check guide 62 defines a spring chamber 84 and a guide passage 86 connecting to the injection chamber 82 of the nozzle 64. The three regions 82, 84, and 86 are collectively known as a check cavity. A check 88 is slidably disposed in the connecting spring chamber 84 and guide passage 86. The check 88 is movable between an open position and a closed position. The check 88 has a spring seat 90 near a lower end portion of the spring chamber 84. A check spring is disposed between the check spring seat 90 and the stop 58, biasing the check 88 to the closed position. The guide passage 86 provides a close fitting relationship with a guide portion 94 of the check, allowing the check 88 to slide freely within the guide passage 86 yet communicate little or no fluid between the injection chamber 82 and the spring chamber 84. The spring chamber 84 is vented to the annular chamber 70 to prevent hydrostatic locking of the check 88 from blocking its upward movement, or slowing its downward return. A tip 96 of the check 88 engages the end portion 66 of the injector body to block the orifice 81. In an open position, the check tip 96 is spaced from the end portion 66, enabling fluid to pass from the injection chamber 82, outward through the orifice(s) 81. That portion of the injector from the pumping piston 26 to the injector end 66 can be identified as the fuel pressurizing and injection unit.

A connector 100, shown in part in FIG. 1B, extends from a fluid communication port 102 of the hydraulic pressure chamber 36. The connector 100, shown more completely in FIG. 2, is attached at a second location to a relief or poppet valve 104 of the injector 10. The connector 100 also has an actuating fluid fill fitting 106 for connecting to a low pressure actuating fluid supply (not shown). The connector 100 has a pair of one-way check valves disposed therein. A first of these is a relief check valve 108 of the ball-and-spring type, permitting flow from the fluid communication port 102 to the relief valve 104, and preventing flow in the opposite direction. The second of the check valves in the connector 100 is an oil fill check valve which enables low pressure hydraulic actuating fluid, such as engine lubrication oil, to be communicated from the low pressure actuating fluid source, through the fluid communication port 102 and to the hydraulic pressure chamber 36. An actuating fluid fill check valve 110 blocks the flow of hydraulic fluid from the fluid communication port 102 toward the low pressure actuating fluid source. The relief valve 104 has a relief valve housing 112 with a central valve bore 114.

A poppet 116 is slidably disposed in the central valve bore 114. The poppet 116 has a seat surface 118 which engages a relief valve housing seat surface 120 when the poppet 116 is in the closed position. The poppet 116 is shown in the closed position in FIG. 2. In the closed position, the engaged poppet end relief valve housing seat surfaces 118, 120, block fluid communication between the connector 100 and a dump port 122 in the relief valve housing 112. When the relief valve 104 is in the open position, the seat surfaces 118, 120, are separated, allowing fluid to flow freely from the connector 100, past the seat surfaces, and through the dump port 122. A poppet valve spring 124 is disposed in the central valve bore 114 between the poppet 116 and the housing 112 to bias the poppet 116 to the open position.

An electrical actuator, such as a solenoid 126, is mounted to the relief valve housing 112. An armature 128 of the solenoid 126 is fixed to the poppet 116 by a threaded fastener 130. The poppet 116 moves with the armature 128 as a unit. The solenoid 126 has an electrical connector 132 so that it can be electronically connected with a control device such as an electronic control module 134. The solenoid 126 can be selectively energized by the signals from the electronic control module 134 to overcome the bias provided by the spring 124 to move the poppet 116 to the closed position. Typically, the electronic control module 134 provides signals to the solenoid 126 through a terminal Sl and similarly provides signals to other injector solenoids (not shown) through terminals S2 through S4 based on inputs of engine and/or vehicle operating parameters S5–S8.

As shown in FIG. 1, a low pressure fuel channel 136 is aligned with a gap between the upper injector body 32 and the casing 68. Fuel enters this gap and flows to the second side 50 of the intensifier piston 38. Fuel is supplied to the fuel fill opening 72 in the casing 68 by a fuel channel 138 in the head aligned with the opening 72.

Industrial Applicability

The injector 10 operates in the following manner. The cam shaft 12 and injector 10 of FIG. 1B are shown in a zero lift position in which the pumping piston 26 is fully extended and hydraulic fluid, which for example may be engine lubricating oil, is not being actively pressurized. Engine oil is supplied to the hydraulic pressure chamber 36 from the low pressure oil source, moving past the oil fill check valve 110, through the connector 100 and the fluid communication port 102, and into the hydraulic pressure chamber 36.

The solenoid 126 is electrically energized, pulling the armature 128 and poppet 116 upward, sealing the poppet seat surface 118 against the relief valve housing seat surface 120. Rotation of the cam shaft 12, with the cam follower 16 moving with the cam lobe 14, causes the push rod 18 to pivot the rocker arm 20. The pivoting rocker arm 20 forces the tappet 24 downward against the pumping piston 26, overcoming the force of the return spring 34 and pressurizing the hydraulic actuating fluid within the hydraulic pressure chamber 36. Continuing displacement of the pumping piston 26 forces hydraulic actuating fluid into the piston chamber 40, displacing the intensifier piston 38.

Intensifier piston displacement forces the plunger 46 to move deeper into the plunger cavity 54, pressurizing the fuel in the fuel pressure chamber 56. The pressure of the fuel in the fuel pressure chamber 56 is approximately equal to the pressure of the engine oil in the piston chamber 40 multiplied by a ratio of the operating surface area of the intensifier piston to the operating surface area of the plunger or Al/A2, which is greater than one. This assumes that the resistance force offered by the piston spring 44 is small relative tn the magnitude of the force against the intensifier piston produced by the pressurized hydraulic actuating fluid. Pressurized fuel passes through the discharge passage 80 to the injection chamber 82. Fuel in the injection chamber 82 forces the check upward, overcoming the check spring 92, and exposing the orifice 81 for fuel to pass therethrough, beginning fuel injection. Continuing downward displacement of pumping piston 26 yields a continuing flow of fuel through the orifice 81. Upward displacement of the check 88 is accommodated by the venting of the spring chamber 84 to the annular chamber 70 to prevent hydrostatic locking of the check.

To end fuel injection, the solenoid 126 is electrically deenergized, with the poppet valve spring 124 resultantly displacing the poppet 116 to the open position, and hydraulic actuating fluid dumping past the relief check valve 108 and the now separated valve seat surfaces 118 and 120 to the dump port 122, relieving the pressure in the hydraulic pressure chamber 36. With the pressure in the hydraulic pressure chamber 36 thus relieved, the piston spring 44 returns the intensifier piston and plunger 46 upward with the intensifier piston 38 engaging the upper injector body 32, dropping the fuel pressure within the injection chamber 82 to a relatively low value. The check spring 92 returns the check 88 to the closed position, with the tip 96 of the check engaging the end portion 66 of the injector and once again blocking the orifice 81 to end fuel injection. This occurs very rapidly, providing a very crisp end to the fuel injection spray. When the plunger 46 is moved upward with the intensifier piston 38, the fuel pressure chamber 56 is refilled with fuel drawn through the one way check valve 78 in the stop 58.

The use of a cam driven pumping piston 26 to provide pressurized hydraulic actuating fluid instead of an external supply pump avoids the expense and packaging necessary to install the external supply pump. Additionally, because there is a relatively low volume of fluid between the pressure source and the injector, the present invention has improved cold start capability when compared to systems employing an external supply pump.

Providing a hydraulic amplifier in the injector with the hydraulic actuating fluid sustaining relatively low pressures which are amplified to high fuel pressure by the combination of the intensifier piston and fuel plunger, permits the use of more generous tolerances for seating geometry of the solenoid poppet against the seat of the housing.

The present system is also an improvement over more conventional electronically regulated fuel injectors in that the dynamics of the relief valve 104 controlling flow to the dump port 122 are much less severe, as it is regulating relatively low pressure hydraulic actuating fluid instead of the high pressure fuel to which valves of conventional injectors would be exposed. A further advantage of the present invention is that the relief valve 104 can be combined with more than a single pressurizing and injection unit. A connector 100 from each unit could extend from a common relief valve housing 112.

Other aspects, objects, and advantages of this invention can be obtained from a study of the drawings, the disclosure and the appended claims.

We claim:

1. A fuel injector adapted for an internal combustion engine comprising:

a cam driven pumping mechanism with a pumping piston operably reciprocating to pressurize a first fluid to a first pressure;

a pressure intensifier mechanism having a first chamber receiving the first fluid at the first pressure from the pumping mechanism, the fluid acting against a first portion of a piston of a first operating surface area slidably disposed in the first chamber and having a second portion of the piston with a second operating surface area smaller than the first operating surface area disposed in part in a second chamber containing a second fluid wherein the second fluid is pressurized to a second pressure approximately equal to the first pressure multiplied by a ratio of the first operating surface area to the second operating surface area;

an injection mechanism having an injection chamber receiving the pressurized second fluid from the intensifier mechanism and having a check selectively blocking at least one injection orifice in an end portion of the injection chamber wherein the check is displaced away from the orifice by the pressurized second fluid; and a relief valve mechanism selectively adjustable between open and closed positions responsive to electronic signals and fluidly connected to the first pressure chamber wherein the pressure in the first pressure chamber is relieved when the relief valve mechanism is in the open position.

2. A fuel injector adapted for an internal combustion engine comprising:

a pumping piston and injector body combination with the piston slidably disposed in an axial bore in the injector body and the injector body and a first end portion of the piston defining a hydraulic pressure chamber at an end portion of the bore;

a fuel pressurizing and injection unit defining a piston chamber in the injector body fluidly connected on a first end portion with the hydraulic pressure chamber having an intensifier piston of a first operative surface area slidably disposed therein with a first side directed to the first end portion and an oppositely facing second side engaging a first end portion of a plunger, the plunger having a second end portion with an operative surface area smaller than the first operative surface area slidably disposed in a plunger cavity of the injector body to define a fuel pressure chamber therein, and the injector body defining a check cavity fluidly connected with the fuel pressure chamber and a check slidably disposed in the check cavity and spring biased to a first position blocking at least one injection orifice in an end portion of the injector body and operably displaced to a second position spaced from the end portion of the body and thereby opening the orifice when fuel in the check cavity reaches a pressure sufficient to overcome the spring bias; and an electronically responsive pressure relief valve fluidly connected with the hydraulic pressure chamber selectively movable between an exhaust position wherein loading of the pumping piston results in hydraulic fluid bypassing the piston chamber and a pressure position wherein loading of the pumping piston results in a loading of the force transfer to the intensifier piston through the hydraulic fluid.

3. A fuel injector adapted for an internal combustion engine comprising:

an injector body having an axial bore;

a pumping piston slidably disposed in a pumping piston portion of the axial bore at a first end portion of the body and defining a hydraulic pressure chamber therein;

a spring disposed between the body and the pumping piston biasing the pumping piston to an extended position;

an intensifier piston slidably disposed in a piston chamber portion of the axial bore having a first operative surface area and having a first side fluidly connected with the hydraulic pressure chamber;

a spring disposed between the piston and the injector body biasing the piston to a non-inject position;

a plunger disposed on a second side of the intensifier piston being slidably disposed in a plunger cavity portion of the axial cavity and defining a moving end of a fuel pressure chamber, the fuel pressure chamber being fluidly connected with a source of fuel through a check valve permitting entry of fuel into the pressure chamber and blocking exit of fuel from the pressure chamber;

a check slidably disposed in a check cavity and operably movable between a closed position in which a tip of the check blocks at least one injection orifice at an end portion of the check cavity and an open position in which the tip of the check is spaced from the end portion of the check cavity;

a spring disposed between the check and the injector body biasing the check to the closed position blocking the injection orifice;

a relief valve fluidly connected with the hydraulic pressure chamber and operably movable between an open position connecting the hydraulic pressure chamber with a low pressure drain point and a closed position blocking flow to the low pressure drain point; and a solenoid connected to the relief valve selectively actuated to displace the relief valve between the open position and the closed position.

* * * * *